US012065290B2

(12) United States Patent
Bagley

(10) Patent No.: US 12,065,290 B2
(45) Date of Patent: Aug. 20, 2024

(54) CONTAINER WITH TERRACOTTA LID

(71) Applicant: Progressive International Corporation, Kent, WA (US)

(72) Inventor: Justin Bagley, Kent, WA (US)

(73) Assignee: Progressive International Corporation, Kent, WA (US)

( * ) Notice: Subject to any disclaimer, the term of this patent is extended or adjusted under 35 U.S.C. 154(b) by 175 days.

(21) Appl. No.: 17/400,384

(22) Filed: Aug. 12, 2021

(65) Prior Publication Data

US 2022/0048683 A1 Feb. 17, 2022

Related U.S. Application Data

(60) Provisional application No. 63/064,479, filed on Aug. 12, 2020.

(51) Int. Cl.
*B65D 43/16* (2006.01)

(52) U.S. Cl.
CPC .. *B65D 43/164* (2013.01); *B65D 2543/00296* (2013.01); *B65D 2543/00537* (2013.01); *B65D 2543/00712* (2013.01)

(58) Field of Classification Search
CPC ..... B65D 43/164; B65D 2543/00296; B65D 2543/00537; B65D 2543/00712;
(Continued)

(56) References Cited

U.S. PATENT DOCUMENTS 4,834,234 A * 5/1989 Sacherer ..... B65D 51/30 206/204
6,382,476 B1 * 5/2002 Randall ..... B65D 47/0885 220/259.2

(Continued)

FOREIGN PATENT DOCUMENTS

EP 3679811 A1 * 7/2020 ..... B65D 51/28
KR 20080076183 A * 8/2008 ..... B65D 51/28
WO WO-9704696 A1 * 2/1997 ..... A47K 1/14

OTHER PUBLICATIONS

Amazon, Product Page Review Oct. 20, 2018, Amazon.com: Progressive Brown Sugar ProKeeper And Powdered Sugar ProKeeper Combo : Home & Kitchen, Amazon—https://www.amazon.com/Progressive-Brown-Sugar-ProKeeper-Powdered/ (Year: 2018).*

(Continued)

*Primary Examiner* — Nathan J Jenness
*Assistant Examiner* — John Martin Hoppmann
(74) *Attorney, Agent, or Firm* — Lowe Graham Jones PLLC

(57) ABSTRACT

A container with a terracotta lid includes a container having a attached to the container and movable between an open position allowing access to the container interior space and a closed position enclosing the container interior space, with a lid opening arranged to allow air to travel from the container interior space through the lid opening when the lid is in the closed position. An access panel allows access to the container interior space through the lid opening. A moisture-retaining insert such as a terracotta material is removably retained between the lid and the access panel when the access panel is in the closed position.

18 Claims, 9 Drawing Sheets

(58) Field of Classification Search
CPC ..... B65D 2251/1016; B65D 43/22; B65D 2543/00101; B65D 43/165; B65D 81/22; B65D 81/266; B65D 2251/10; B65D 25/10; B65D 51/28; B65D 51/14; B65D 51/20; B65D 2251/0003; B65D 51/30; B65D 43/161; A47J 47/10; F16K 15/023; A23L 3/3427
USPC ..... 220/524, 259.1, 4, 256.1, 190, 521, 220/254.3, 300; 206/204, 656, 564, 490, 206/439, 213.1; 222/563
See application file for complete search history.

(56) References Cited

U.S. PATENT DOCUMENTS

| | | | | |
|---|---|---|---|---|
| 8,844,751 | B2 * | 9/2014 | Sakaguchi | B65F 1/1607 220/495.11 |
| D865,439 | S * | 11/2019 | Matsumoto | D7/391 |
| 2007/0199841 | A1 * | 8/2007 | Mesalic | B65D 83/0805 206/233 |
| 2019/0100370 | A1 * | 4/2019 | Kieling | B65D 45/20 |
| 2020/0039725 | A1 * | 2/2020 | Parsons | B65D 81/24 |

OTHER PUBLICATIONS

OXO Pop Brown Sugar Keeper, OXO website, available at oxo.com/oxo-pop-brown-sugar-keeper.html#.

* cited by examiner

CONTAINER WITH TERRACOTTA LID

BACKGROUND OF THE INVENTION

The present invention relates generally to food storage containers.

BACKGROUND OF THE INVENTION

It is useful to include a piece of clay, often in the form of a terracotta disk, in a container for brown sugar. The terracotta can be soaked in water, and once placed in the container with brown sugar the moisture can release slowly to help prevent the brown sugar from drying out. Commonly, however, the disk becomes coated with sugar, or buried within the sugar, requiring a user to dig it out and clean it periodically to add moisture to it. The disk is also in the way of a spoon or scoop when attempting to take sugar from the container, so the disk frequently must be maneuvered out of the way to allow access to the sugar. While the use of such a disk is valuable, an improved structure for incorporating it is needed.

SUMMARY OF THE INVENTION

A preferred food keeper is configured with a container having a base and a sidewall extending upwardly from the base and terminating in a rim to define a container interior space. A lid is removably attached to the container and movable between an open position allowing access to the container interior space and a closed position enclosing the container interior space, the lid further having a lid opening arranged to allow air to travel from the container interior space through the lid opening when the lid is in the closed position. An access panel has an access panel internal space, the access panel being moveable between a closed position enclosing the lid opening and an open position allowing access to the container interior space through the lid opening. A moisture-retaining insert is removably retained between the lid and the access panel when the access panel is in the closed position.

In some versions, the lid further comprises a seat spaced below the access panel when the access panel is in the closed position, the moisture-retaining insert being supported by the seat.

In some versions, the seat is configured as a radially inward-directed flange, and the opening is positioned inwardly from the inward-directed flange.

In some versions, the seat is positioned downwardly from the lid and within the interior space when the lid is in the closed position.

In some versions, the lid is pivotally attached to the container at a pivot axis. The access panel may also be pivotally attached to the lid, and in some versions it is pivotally attached at the same pivot axis.

In some versions, the moisture-retaining insert is formed from a terracotta material and includes a base and a raised knob, the raised knob being received within the access panel internal space when the access panel is in the closed position.

In some versions, the preferred food keeper includes a lid having a compartment positioned on the lid, the compartment having an access panel moveable between a closed position enclosing the compartment and an open position allowing access to the compartment, the compartment further having an opening arranged to allow air to travel between the container and the compartment when the lid is in the closed position and the access panel is in the closed position.

The moisture-retaining insert, preferably terracotta, is removably enclosed within the compartment when the access panel is in the closed position.

In some versions, the compartment includes a seat spaced below the access panel when the access panel is in the closed position, the moisture-retaining insert being supported by the seat.

In some versions, the seat is configured as a radially inward-directed flange, and the opening is positioned inwardly from the inward-directed flange.

In some versions, the compartment extends downwardly from the lid and into the interior space when the lid is in the closed position.

In some versions, the access panel includes a lower annular projection having a concave interior, the lower annular projection having a resilient flange extending radially away from the lower annular projection.

In some versions, the moisture-retaining insert is received within the concave interior of the access panel when the access panel is in the closed position.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

A preferred version of a container with a terracotta lid is shown in the accompanying figures. In general, the container is sized and arranged to hold a quantity of brown sugar, and includes a main lid which can selectively be opened and closed to allow access to the container to remove sugar. The main lid covers a main opening spanning the top of the container.

A second lid, or access panel, is also provided, and in a preferred version the access panel is much smaller, and most preferably just large enough to allow access to a moisture-retaining insert which is housed inside the container. In a preferred example, the moisture-retaining insert is housed in a compartment provided within the lid, in which the compartment has an opening which allows air to travel from the container into the compartment. A second opening is covered by the access panel, allowing insertion or removal of the insert by opening the access panel. In other versions, the access panel and compartment are located in a different position on the container, rather than on the main lid. It should be appreciated that the moisture-retaining insert, as used in this description refers generally solid porous materials such as terracotta, clay, stone, or similar materials which can absorb moisture in a manner similar to terracotta, and release the retained moisture slowly.

Figure 1:
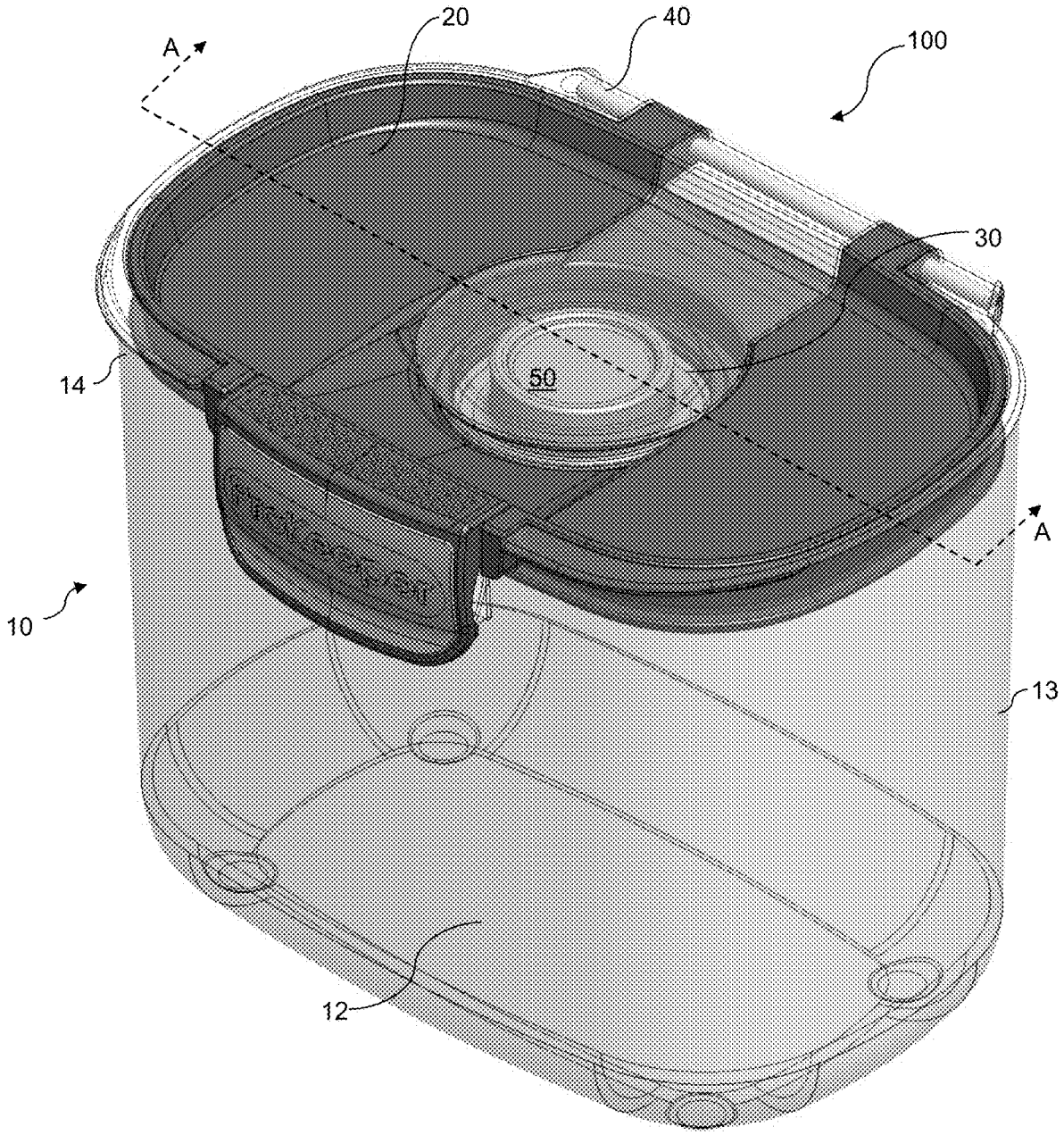
FIG. 1 is a top isometric view of a preferred container with a terracotta lid.

FIG. 1 illustrates a preferred version of a container with terracotta lid 100. A container 10 is shown, and is configured with a base or floor 12, an upwardly extending sidewall 13, and a rim 14 defining an interior space capable of holding a quantity of material such as brown sugar. In a preferred version, the container defines a volume of 1.5 quarts. A lid 20 is pivotally attached to the container, and in one version it is attached via a rod 40 supported by the container to allow the lid to pivotally open and close. The lid abuts the rim in order to seal the container when the lid is in the closed position and to allow access to the interior space when the lid is in the open position.

An access panel, or smaller lid 30, is provided. In the illustrated example, the access panel is pivotally attached to the same rod 40, or otherwise pivots about same pivot axis as that of the lid, which in the illustrated example is defined by the rod 40. Alternatively, the access panel may pivot about a separate axis, such as an axis defined on the lid, or may be frictionally and removably attached to the lid without a pivotal connection.

In one version, as illustrated, the access panel is centrally located within the lid, allowing access to the container through an opening in the lid by opening and closing the access panel. As shown in FIG. 1, the access panel is in the closed position. While both the lid and the access panel are illustrated as being pivotally movable between open and closed positions, in other versions the lid and access panel are fully separable such that they may be removed entirely from the container rather than pivoting. In FIG. 1, the access panel is illustrated as being clear, such as by being formed from a clear plastic material. Alternatively, as illustrated in some of the other drawings, the access panel may be opaque or colored, rather than clear. In either case, the access panel is otherwise structurally the same.

Figure 2:
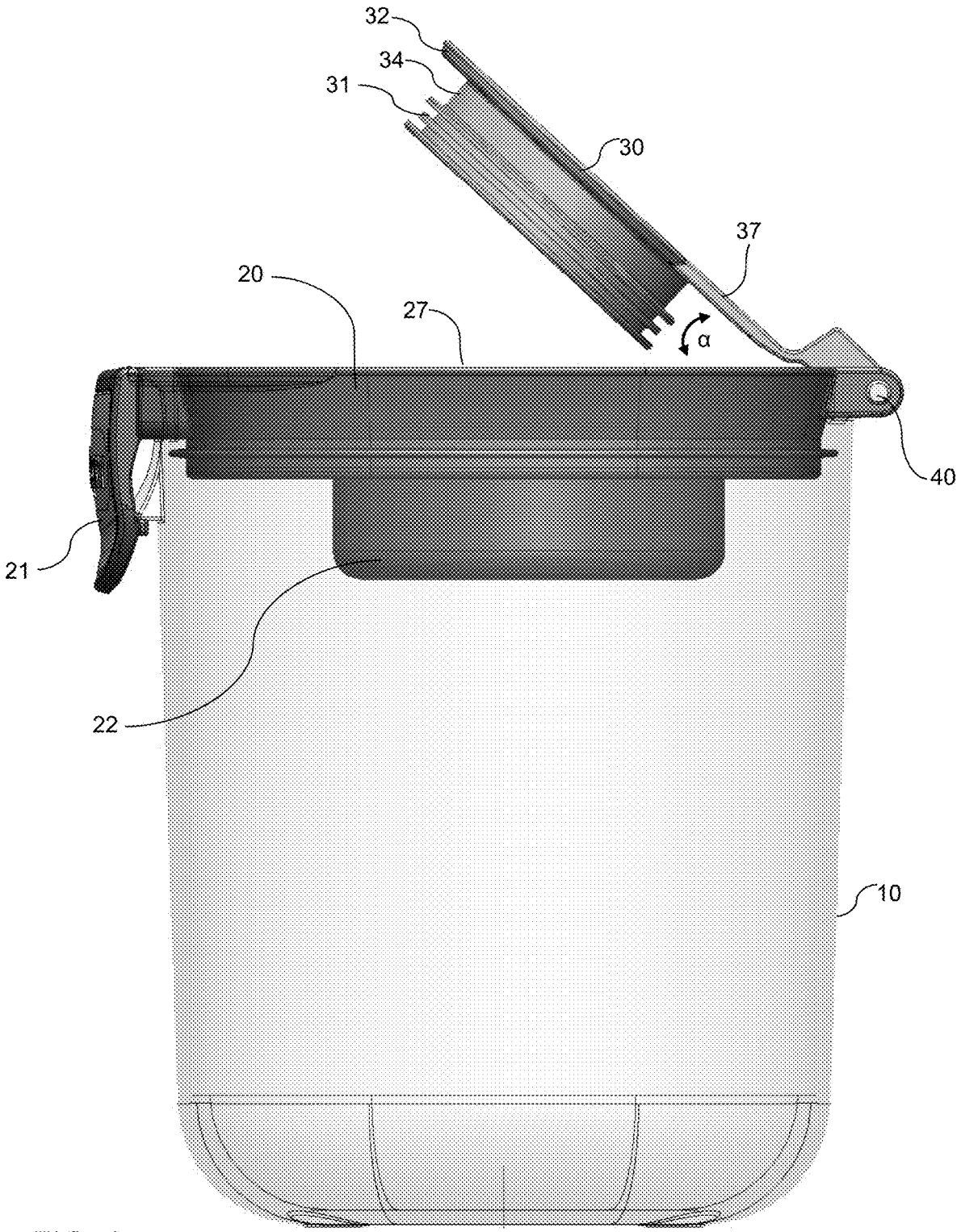
FIG. 2 is a side elevational view of a container with a terracotta lid, shown with the lid closed but with an access panel opened.

FIG. 2 shows the access panel 30 pivoted away from the lid 20 to an open position, and in this illustration the access panel is illustrated as being opaque rather than clear. In the illustrated example, the access panel may pivot through an angle (indicated by the angle $\alpha$ shown in FIG. 2, defined as the angle between the upper surface 27 of the lid and the upper surface 37 of the access panel) of as much as 270 degrees, and the "open" position should be understood to be a position in which the access panel is moved away from the closed position sufficiently to allow access to the opening within the lid that lies beneath the access panel when it is in the closed position. The access panel preferably also includes a resilient seal 31, which may be in the form of one or more annular ridges extending radially outwardly about a lower annular projection 34 on the panel. An upper flange 32 extends outwardly at the upper surface of the access panel to further seal the container when the access panel is in the closed position.

Figure 4:
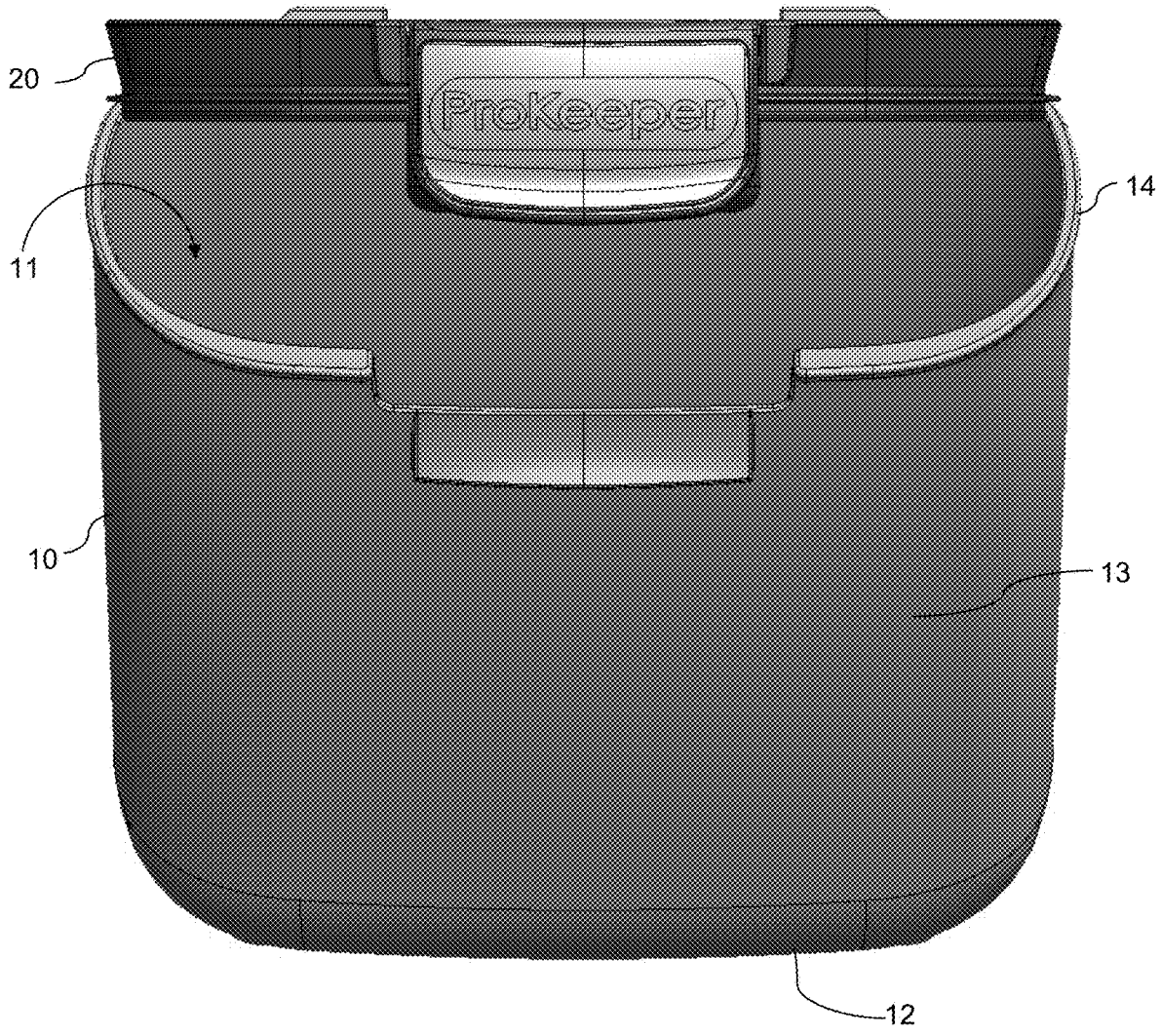
FIG. 4 is a front-top isometric view of a container with a terracotta lid, shown with the lid partially opened.

As also seen in FIG. 2, a latch 21 is provided on the lid 20 in the preferred example, to hold the lid in the closed position as illustrated. When the lid is pivoted to the open position, as shown in FIG. 4, access is provided to an interior space 11 within the container, as defined by the base 12 and sidewalls 13 which extend upwardly to the rim 14 of the container 10.

In the preferred version, the lid 20 includes a recessed compartment 22 configured essentially as a cavity extending downwardly and away from the upper surface of the lid, to receive and hold a terracotta disk. When the lid is in the closed position, the cavity extends downwardly and into the interior space of the container.

Figure 3:
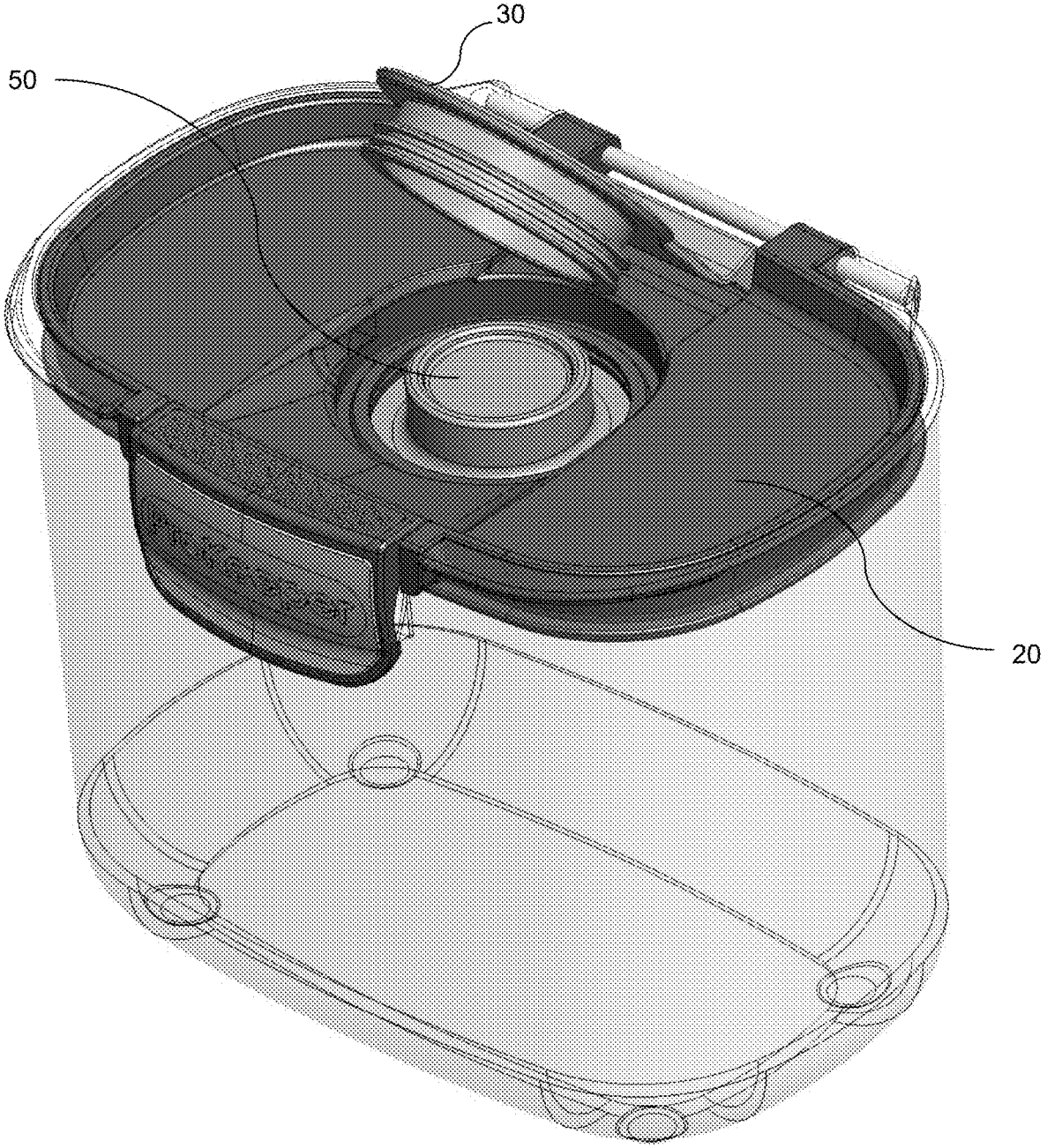
FIG. 3 is a top isometric view of a container with a terracotta lid, shown with the lid closed but with the access panel opened.

As illustrated in FIG. 3, a moisture-retaining insert 50 is provided and removably seated within the recessed compartment of the lid. The insert is illustrated as having a circular circumference (when viewed from the top) such as with a terracotta disk, and is supported within the compartment and accessible when the access panel 30 is pivoted to an open position, such as is the case in FIG. 3.

Figure 5:
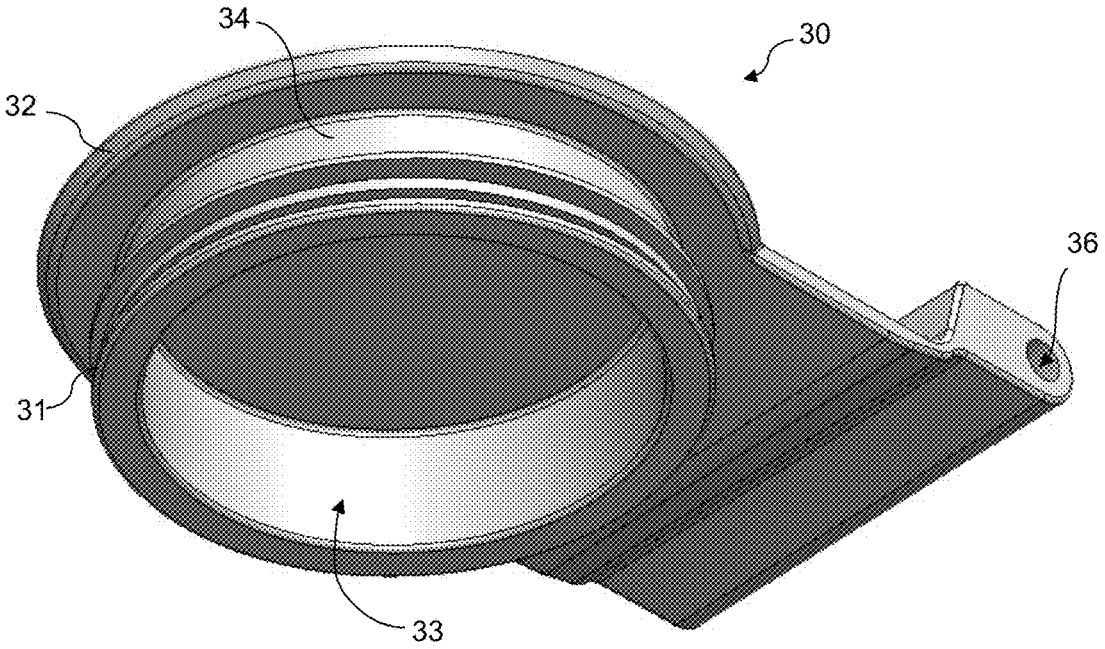
FIG. 5 is a bottom isometric view of an access panel, shown removed from the container and terracotta lid.
Figure 6:
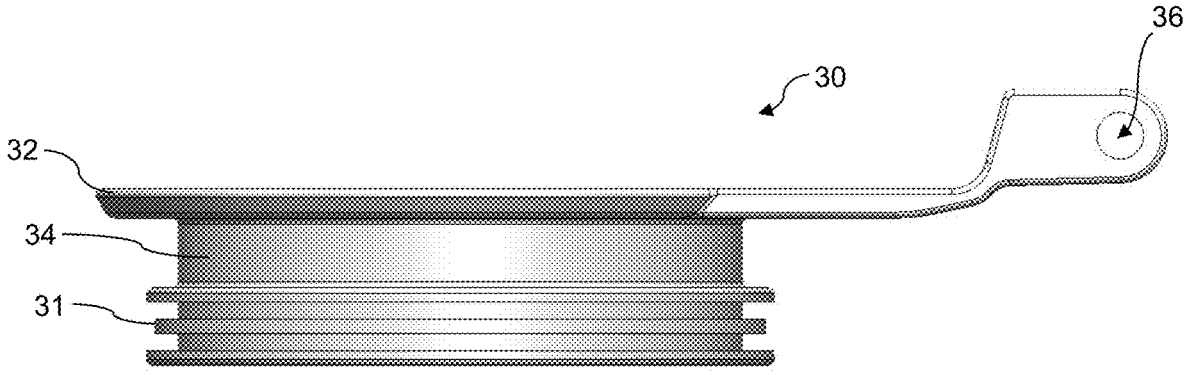
FIG. 6 is a side elevational view of an access panel, shown removed from the container and terracotta lid.

The preferred access panel is shown separately from the lid or container in FIGS. 5 and 6. As illustrated, a rearward end of the access panel includes a central bore 36 which receives the rod 40 as shown in FIG. 1. A forward end of the access panel (near reference number 32 in FIG. 5) seals the access opening 28 provided in the lid. Preferably, the forward end of the access panel includes a substantially cylindrical lower annular projection 34, most preferably having a raised or concave interior defining an access panel internal space 33. The access panel internal space is configured to receive an upper portion of the terracotta insert. Although the preferred lid and access panel are attached by a rod extending through holes as described, it should be appreciated that a pivotal connection can be achieved in a different fashion.

Figure 7:
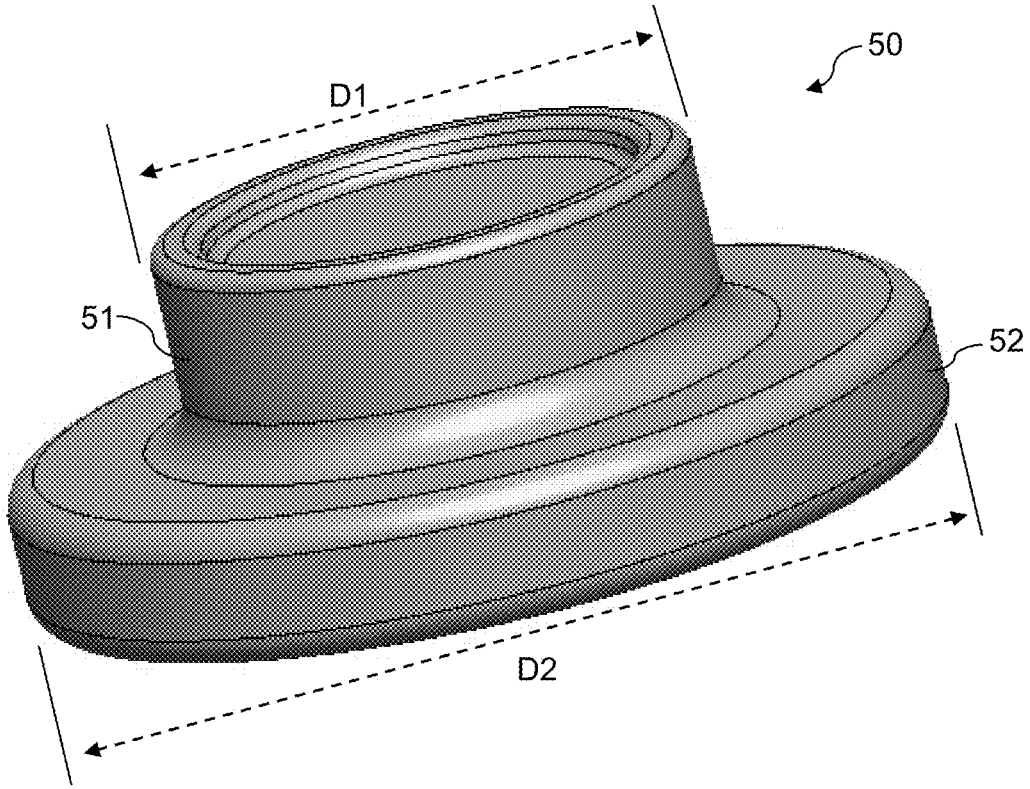
FIG. 7 is a top isometric view of a preferred terracotta disk for use with a container and terracotta lid.

A preferred shape for a terracotta insert is shown in FIG. 7. As illustrated, it includes a base 52 having a circular perimeter, and a raised knob 51. Most preferably, the raised knob has a smaller knob diameter D1 than the base diameter D2 of the base, to provide a handle for grasping the insert.

Figure 8:
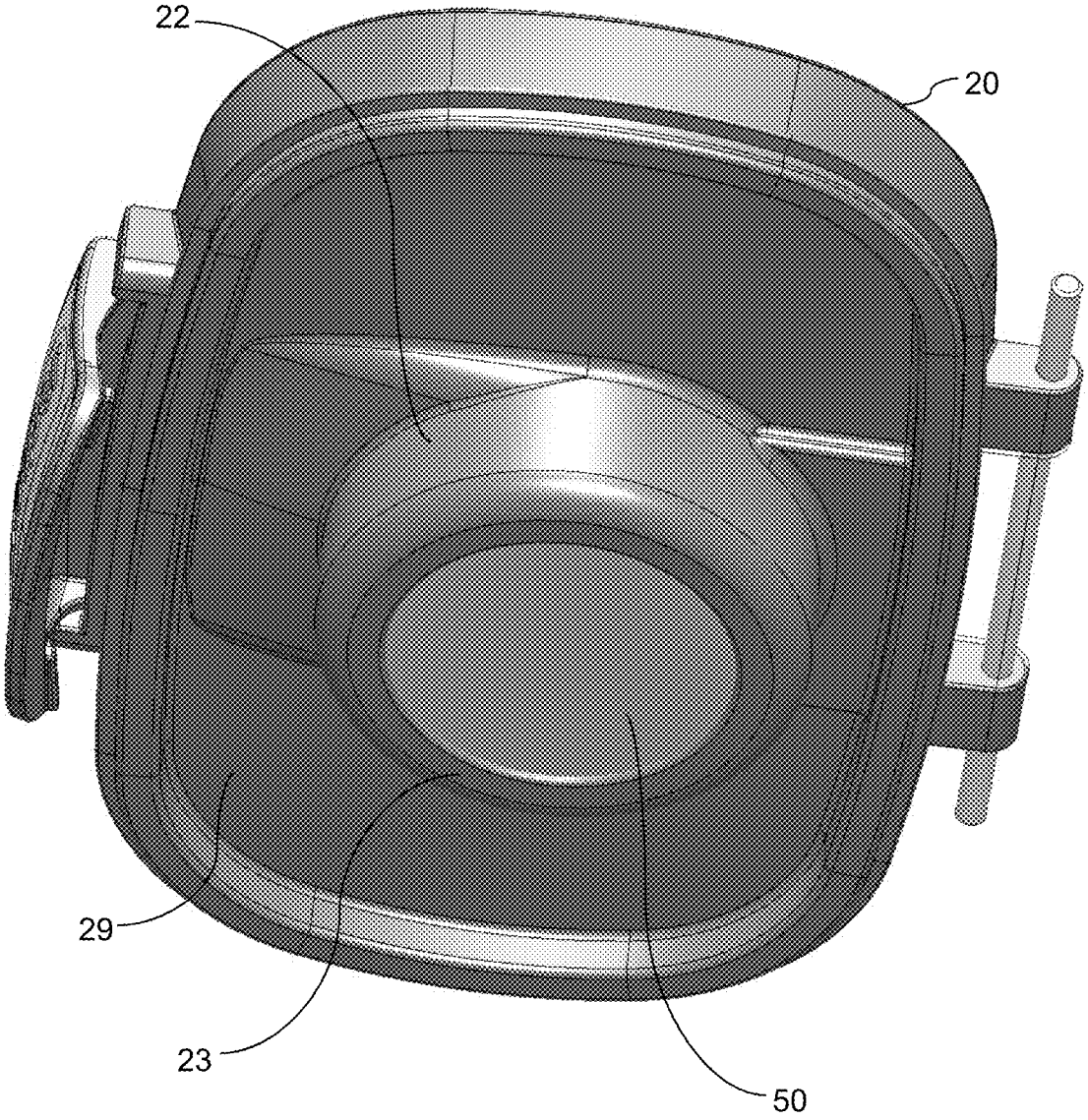
FIG. 8 is a bottom isometric view of a preferred terracotta lid, shown removed from the container.
Figure 9:
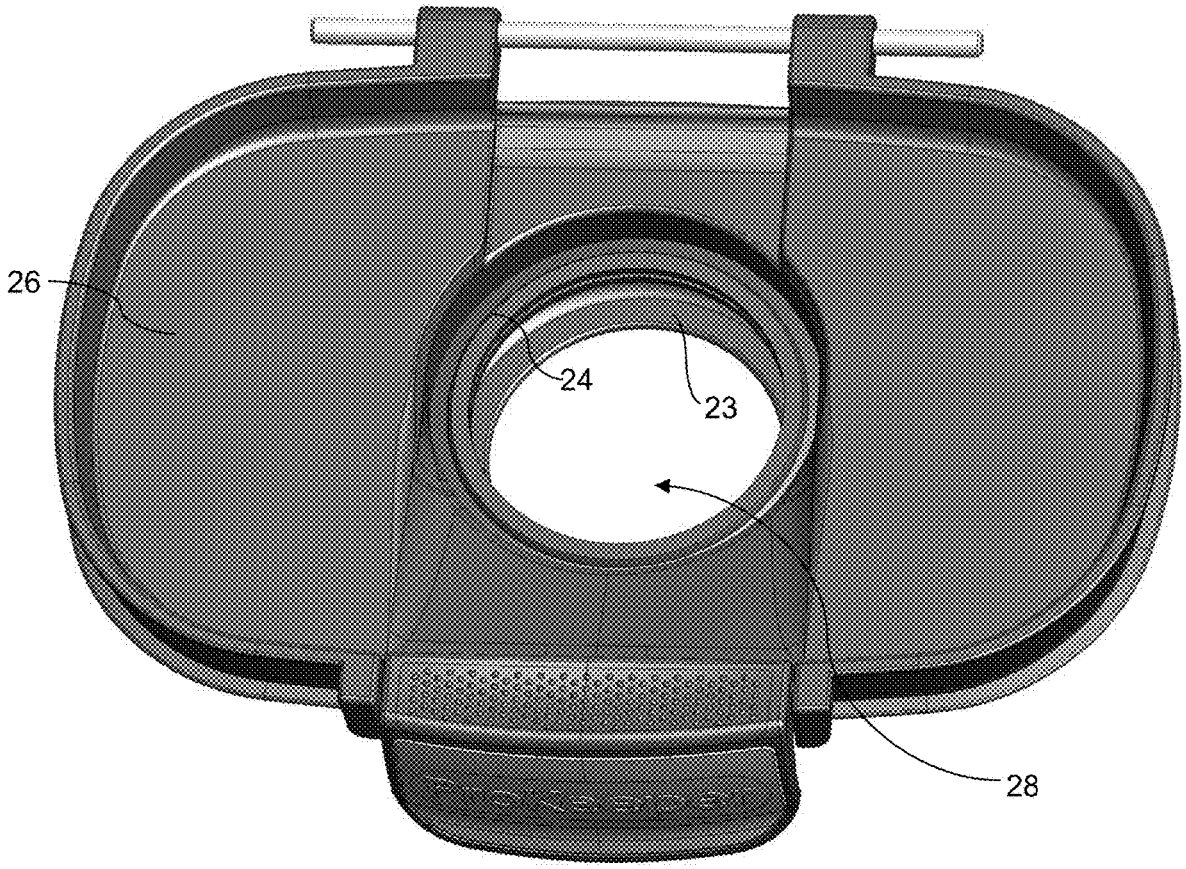
FIG. 9 is a top view of a preferred terracotta lid, shown removed from the container and with the access panel removed.

The interior of the lid (or the lower side 29) is seen in FIG. 8 with a moisture-retaining insert 50 shown in position in the compartment 22, while the exterior (or upper side 26) of the lid is shown in FIG. 9 with the insert removed and the access panel also removed for ease of illustration. For simplicity, in FIGS. 8 and 9 the lid is shown without the container 10.

The compartment 22 preferably includes an inwardly-directed flange 23 defining a seat for supporting the terracotta insert 50. An opening 28 is provided in the lid, within the compartment (see FIG. 9), providing access through the lid and into the interior of the container when the terracotta insert is removed, as is the case in FIG. 9. Thus, when the access panel is pivoted to an open position, air (or a spoon) can travel freely from outside the container to the inside of the container, or vice-versa, so long as the terracotta insert is removed. As seen in FIG. 9, an upper sealing flange 24 is provided within the lid and preferably spaced above an upper surface of the seat 23, having a diameter substantially the same as that of the lower support flange or seat 23. When the moisture-retaining insert is inserted into the compartment, the base of the terracotta insert is sandwiched between the seat 23 and the sealing flange 24 to help provide a seal for the container. In one version, the flange is formed from an elastomeric material, and the moisture-retaining insert is sized and configured with respect to the compartment and its seat and sealing flange to provide a snug it and an airtight seal when the insert is in position within the compartment.

Figure 10:
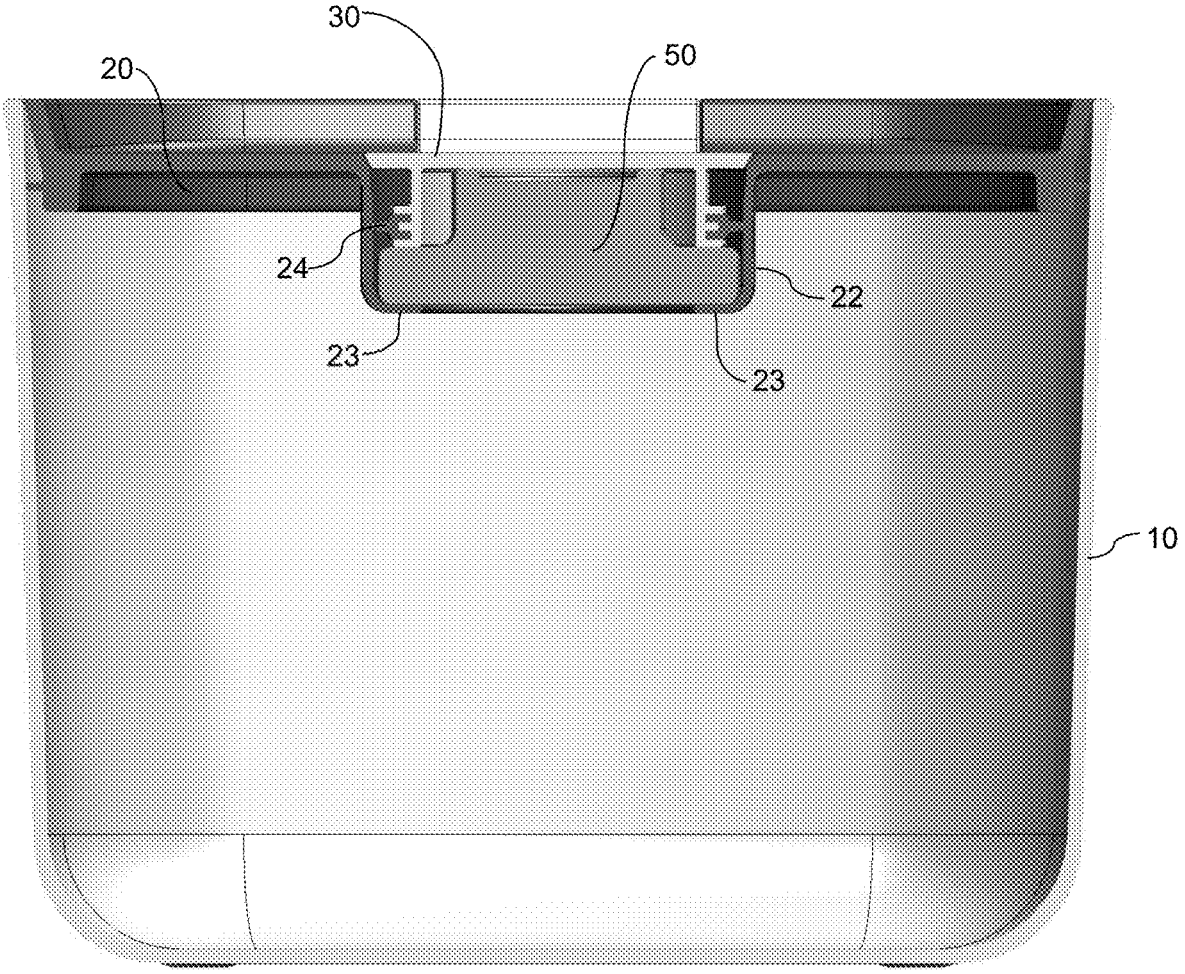
FIG. 10 is a front sectional view, taken along plane A-A in FIG. 1.

FIG. 10 provides a sectional view, taken along section line A-A in FIG. 1. In this illustration, the terracotta insert 50 is shown sandwiched between the seat 23 and sealing flange 24. Both the lid and access panel are in the closed positions, enclosing and sealing the container.

In most cases, the footprint of the compartment (that is, its area when looking down upon it such as in FIG. 9) can occupy a small portion of the area of the lid, and most preferably less than about 25% of the surface area. In other versions, however, the access panel occupies the same size or footprint as the main lid. In such a case, the main lid preferably is configured to include a compartment generally consistent with the description above, to hold an insert above the interior of the container. The "lid" in this example may not fully cover the rim of the container, however, and may instead be mainly configured to provide the compartment and a structure for supporting it atop the rim. The access panel in this version may span the entirety of the area defined by the rim. As with the version described above, preferably in this version the access panel may be removed, or pivoted away, from the container separately from the lid and compartment, or may be removed, or pivoted away, together with the lid and compartment.

In use, a user may gain access to the container by opening the lid together with the access panel, opening or rotating the entire structure in the manner as illustrated in FIG. 4, to thereby provide a wide-opening access to the container. In such a case, a large scoop or measuring cup may be inserted. The insert is retained in the compartment and enclosed by the access panel, such that the act of opening the lid also moves the disk out of the way.

Alternatively, a user may open the access port and remove the terracotta insert, allowing for only a spoon to be inserted through the access port. Likewise, the insert may be removed and soaked in water by opening the access panel to remove it. The terracotta insert should be soaked in water before being seated in the compartment of the lid initially. Occasionally it will dry out, and then it should be removed, soaked, and replaced again.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

I claim:

1. A food keeper, comprising:

a container having a base and a sidewall extending upwardly from the base and terminating in a rim to define an interior space;

a lid attached to the container and movable between an open position allowing access to the interior space and a closed position enclosing the interior space;

the lid having a compartment positioned on the lid, the compartment having an access panel moveable between a closed position enclosing the compartment and an open position allowing access to the compartment, the compartment further having an opening arranged to allow air to travel between the container and the compartment when the lid is in the closed position and the access panel is in the closed position;

the compartment further having a seat below the access panel when the access panel is in the closed position, the seat being configured as a radially inward-directed flange defining a diameter of the opening; and a moisture-retaining insert removably enclosed within the compartment and supported by the flange when the access panel is in the closed position.

2. The food keeper of claim 1, wherein the compartment extends downwardly from the lid and into the interior space when the lid is in the closed position.

3. The food keeper of claim 2, wherein the lid is pivotally attached to the container at a pivot axis.

4. The food keeper of claim 3, wherein the access panel is pivotally attached to the lid.

5. The food keeper of claim 4, wherein the access panel is pivotally attached at the pivot axis.

6. The food keeper of claim 4, wherein the access panel further comprises a lower annular projection having a concave interior, the lower annular projection further having a resilient flange extending radially outwardly from the lower annular projection.

7. The food keeper of claim 6, wherein the moisture-retaining insert is received within the concave interior of the access panel when the access panel is in the closed position.

8. The food keeper of claim 7, wherein the moisture-retaining insert further comprises a base and a raised knob, the raised knob being received within the concave interior of the access panel when the access panel is in the closed position.

9. The food keeper of claim 1, wherein the moisture-retaining insert is formed from terracotta.

10. The food keeper of claim 1, wherein a base of the moisture-retaining insert has a circular perimeter having a raised knob diameter and the base of the moisture-retaining insert has a circular perimeter having a base diameter, the base diameter being larger than the raised knob diameter.

11. A food keeper, comprising:

a container having a base and a sidewall extending upwardly from the base and terminating in a rim to define a container interior space;

a lid removably attached to the container and movable between an open position allowing access to the container interior space and a closed position enclosing the container interior space, the lid further having a lid opening arranged to allow air to travel from the container interior space through the lid opening when the lid is in the closed position;

an access panel having an access panel internal space, the access panel being moveable between a closed position enclosing the lid opening and an open position allowing access to the container interior space through the lid opening; and a moisture-retaining insert removably retained between the lid and the access panel when the access panel is in the closed position;

the moisture-retaining insert being formed from terracotta and having a base and a raised knob, the raised knob being smaller than the base.

12. The food keeper of claim 11, wherein the lid further comprises a seat spaced below the access panel when the access panel is in the closed position, the moisture-retaining insert being supported by the seat.

13. The food keeper of claim 12, wherein seat is configured as a radially inward-directed flange, and further wherein the opening is positioned inwardly from the inward-directed flange.

14. The food keeper of claim 13, wherein the seat is positioned downwardly from the lid and within the interior space when the lid is in the closed position.

15. The food keeper of claim 12, wherein the lid is pivotally attached to the container at a pivot axis.

16. The food keeper of claim 15, wherein the access panel is pivotally attached to the lid.

17. The food keeper of claim 16, wherein the access panel is pivotally attached at the pivot axis.

18. The food keeper of claim 11, wherein the raised knob is received within the access panel internal space when the access panel is in the closed position.

* * * * *